US007922832B2

(12) United States Patent
Nakamura et al.

(10) Patent No.: US 7,922,832 B2
(45) Date of Patent: Apr. 12, 2011

(54) METHOD FOR PREPARING PERMANENT MAGNET MATERIAL

(75) Inventors: Hajime Nakamura, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 322 days.

(21) Appl. No.: 11/783,143

(22) Filed: Apr. 6, 2007

(65) Prior Publication Data

US 2007/0240787 A1 Oct. 18, 2007

(30) Foreign Application Priority Data

Apr. 14, 2006 (JP) ..... 2006-112306

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS

| | | | | |
|---|---|---|---|---|
| 4,942,098 | A * | 7/1990 | Hamamura et al. | 428/555 |
| 5,082,745 | A * | 1/1992 | Ohashi | 428/552 |
| 5,173,206 | A * | 12/1992 | Dickens et al. | 252/62.54 |
| 6,994,756 | B2 * | 2/2006 | Yamada et al. | 148/101 |
| 2005/0028892 | A1 * | 2/2005 | Sasaki | 148/302 |

FOREIGN PATENT DOCUMENTS

| | | | |
|---|---|---|---|
| EP | 0345092 | A1 | 6/1989 |
| EP | 0924717 | A2 | 6/1999 |
| JP | 04-165012 | A | 6/1992 |
| JP | 07-037742 | A | 2/1995 |
| JP | 10-064746 | A | 3/1998 |
| JP | 2004-281492 | A | 10/2004 |
| JP | 2004-281493 | A | 10/2004 |

OTHER PUBLICATIONS

European Search Report dated Jun. 4, 2008, issued in corresponding European Patent Application No. 07251518.2.

Gutfleisch, Oliver et al., "Characterisation of Rare Earth-Transition Metal Alloys with Resistivity Measurements", IEEE Transactions on Magnetics, vol. 29, No. 6, pp. 2872-2874, Nov. 1993.

Takiishi, H. et al., "The influence of process parameters and alloy structure on the magnetic properties of NdDyFeBNb HD sintered magnets", Journal of Materials Processing Technology, vol. 152, No. 1, pp. 1-8, Oct. 1, 2004.

Hajime Nakamura, et al., "Microstructures of the anisotropic Nd-Fe-B HDDR treated powder," The Papers of Technical Meetings on Magnetics, Nov. 17, 1998, pp. 31-36, Technical Meeting on Magnetics, The Institute of Electrical Engineers of Japan.

Japanese Office Action issued Sep. 29, 2010 in corresponding Japanese Patent Application 2003-112306.

* cited by examiner

*Primary Examiner* — John P Sheehan

(74) *Attorney, Agent, or Firm* — Westerman, Hattori, Daniels & Adrian, LLP

(57) ABSTRACT

A permanent magnet material is prepared by machining an anisotropic sintered magnet body having the compositional formula: $R_x(Fe_{1-y}Co_y)_{100-x-z-a}B_zM_a$ wherein R is Sc, Y or a rare earth element, M is Al, Cu or the like, to a specific surface area of at least 6 $mm^{-1}$, heat treating in a hydrogen gas-containing atmosphere at 600-1,100° C. for inducing disproportionation reaction on the $R_2Fe_{14}B$ compound, and continuing heat treatment at a reduced hydrogen gas partial pressure and 600-1,100° C. for inducing recombination reaction to the $R_2Fe_{14}B$ compound, thereby finely dividing the $R_2Fe_{14}B$ compound phase to a crystal grain size ≦1 μm.

8 Claims, 1 Drawing Sheet

METHOD FOR PREPARING PERMANENT MAGNET MATERIAL

CROSS-REFERENCE TO RELATED APPLICATION

This non-provisional application claims priority under 35 U.S.C. §119(a) on Patent Application No. 2006-112306 filed in Japan on Apr. 14, 2006, the entire contents of which are hereby incorporated by reference.

TECHNICAL FIELD

This invention relates to an R—Fe—B permanent magnet designed to prevent magnetic properties from deterioration by surface machining of sintered magnet body, and more particularly, to a method for preparing a high-performance rare earth permanent magnet material of compact size or reduced thickness having a specific surface area (S/V) of at least 6 $mm^{-1}$.

BACKGROUND ART

By virtue of excellent magnetic properties, R—Fe—B permanent magnets as typified by Nd—Fe—B systems find an ever increasing range of application. For modern electronic equipment having magnets built therein including computer-related equipment, hard disk drives, CD players, DVD players, and mobile phones, there are continuing demands for weight and size reduction, better performance, and energy saving. Under the circumstances, R—Fe—B magnets, and among others, high-performance R—Fe—B sintered magnets must clear the requirements of compact size and reduced thickness. In fact, there is an increasing demand for magnets of compact size or reduced thickness as demonstrated by a magnet body with a specific surface area (S/V) in excess of 6 $mm^{-1}$.

To process an R—Fe—B sintered magnet of compact size or thin type to a practical shape so that it may be mounted in a magnetic circuit, a sintered magnet in compacted and sintered block form must be machined. For the machining purpose, outer blade cutters, inner blade cutters, surface machines, centerless grinding machines, lapping machines and the like are utilized.

However, it is known that when an R—Fe—B sintered magnet is machined by any of the above-described machines, magnetic properties become degraded as the size of a magnet body becomes smaller. This is presumably because the machining deprives the magnet surface of the grain boundary structure that is necessary for the magnet to develop a high coercive force. Making investigations on the coercive force in proximity to the surface of R—Fe—B sintered magnets, the inventors found that when the influence of residual strain by machining is minimized by carefully controlling the machining rate, the average thickness of an affected layer on the machined surface becomes approximately equal to the average crystal grain size as determined from the grain size distribution profile against the area fraction. In addition, the inventors proposed a magnet material wherein the crystal grain size is controlled to 5 μm or less during the magnet preparing process in order to mitigate the degradation of magnetic properties (JP-A 2004-281492). In fact, the degradation of magnetic properties can be suppressed to 15% or less even in the case of a minute magnet piece having S/V in excess of 6 $mm^{-1}$. However, the progress of the machining technology has made it possible to produce a magnet body having S/V in excess of 30 $mm^{-1}$, which gives rise to a problem that the degradation of magnetic properties exceeds 15%.

The inventors also found a method for tailoring a sintered magnet body machined to a small size, by melting only the grain boundary phase, and diffusing it over the machined surface for restoring magnetic properties of surface particles (JP-A 2004-281493). The magnet body tailored by this method still has the problem that corrosion resistance is poor when its S/V is in excess of 30 $mm^{-1}$.

Methods for the preparation of R—Fe—B magnet powder for bonded magnets include the hydrogenation-disproportionation-desorption-recombination (HDDR) process. When an anisotropic magnet powder is prepared by the HDDR process, it consists of crystal grains with a size of about 200 nm which is smaller than the grain size in sintered magnets by one or more order, and particles of degraded properties present at the magnet surface in a magnet powder with a size of 150 μm (S/V=40) account for only 1% by volume at most. Then no noticeable degradation of properties is observable. However, bonded magnets prepared therefrom have a maximum energy product of about 17 to 25 MGOe, which value is as low as one-half or less the maximum energy product of sintered magnets.

It was thus believed difficult in a substantial sense to produce an R—Fe—B ultrafine magnet body having excellent magnetic properties and free of degradation thereof.

DISCLOSURE OF THE INVENTION

An object of the invention is to provide a method for preparing a rare earth permanent magnet material in the form of an R—Fe—B anisotropic sintered magnet wherein magnetic properties once degraded by machining are restored.

Regarding a sintered magnet body as machined, the inventors have found that its magnetic properties degraded by machining are restored by subjecting the sintered magnet body to heat treatment in a hydrogen atmosphere and subsequent heat treatment in a dehydrogenating atmosphere.

The invention provides a method for preparing a permanent magnet material, comprising the steps of:

providing an anisotropic sintered magnet body having the compositional formula: $R_x(Fe_{1-y}Co_y)_{100-x-z-a}B_zM_a$ wherein R is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R_2Fe_{14}B$ compound as a primary phase, machining the magnet body to a specific surface area of at least 6 $mm^{-1}$, heat treating in a hydrogen gas-containing atmosphere at 600 to 1,100° C., for inducing disproportionation reaction on the $R_2Fe_{14}B$ compound, and continuing heat treatment in an atmosphere having a reduced hydrogen gas partial pressure at 600 to 1,100° C., for inducing recombination reaction to the $R_2Fe_{14}B$ compound, thereby finely dividing the $R_2Fe_{14}B$ compound phase to a crystal grain size equal to or less than 1 μm.

The method may further comprise the step of washing the machined magnet body with at least one agent of alkalis, acids and organic solvents, prior to the disproportionation reaction treatment, or the step of shot blasting the machined magnet body for removing a surface affected layer therefrom, prior to the disproportionation reaction treatment.

The method may further comprise the step of washing the magnet body with at least one agent of alkalis, acids and organic solvents, after the recombination reaction treatment.

The method may further comprise the step of machining the magnet body, after the recombination reaction treatment.

The method may further comprise the step of plating or coating the magnet body, after the recombination reaction treatment, or after the alkali, acid or organic solvent washing step following the recombination reaction treatment, or after the machining step following the recombination reaction treatment.

BENEFITS OF THE INVENTION

According to the invention, permanent magnets exhibiting excellent magnetic properties despite a compact size or thin wall corresponding to S/V of at least 6 $mm^{-1}$ are obtained because their magnetic properties once degraded by machining are restored.

BRIEF DESCRIPTION OF THE DRAWING

The only FIGURE.

DESCRIPTION OF THE PREFERRED EMBODIMENTS

Figure 1:
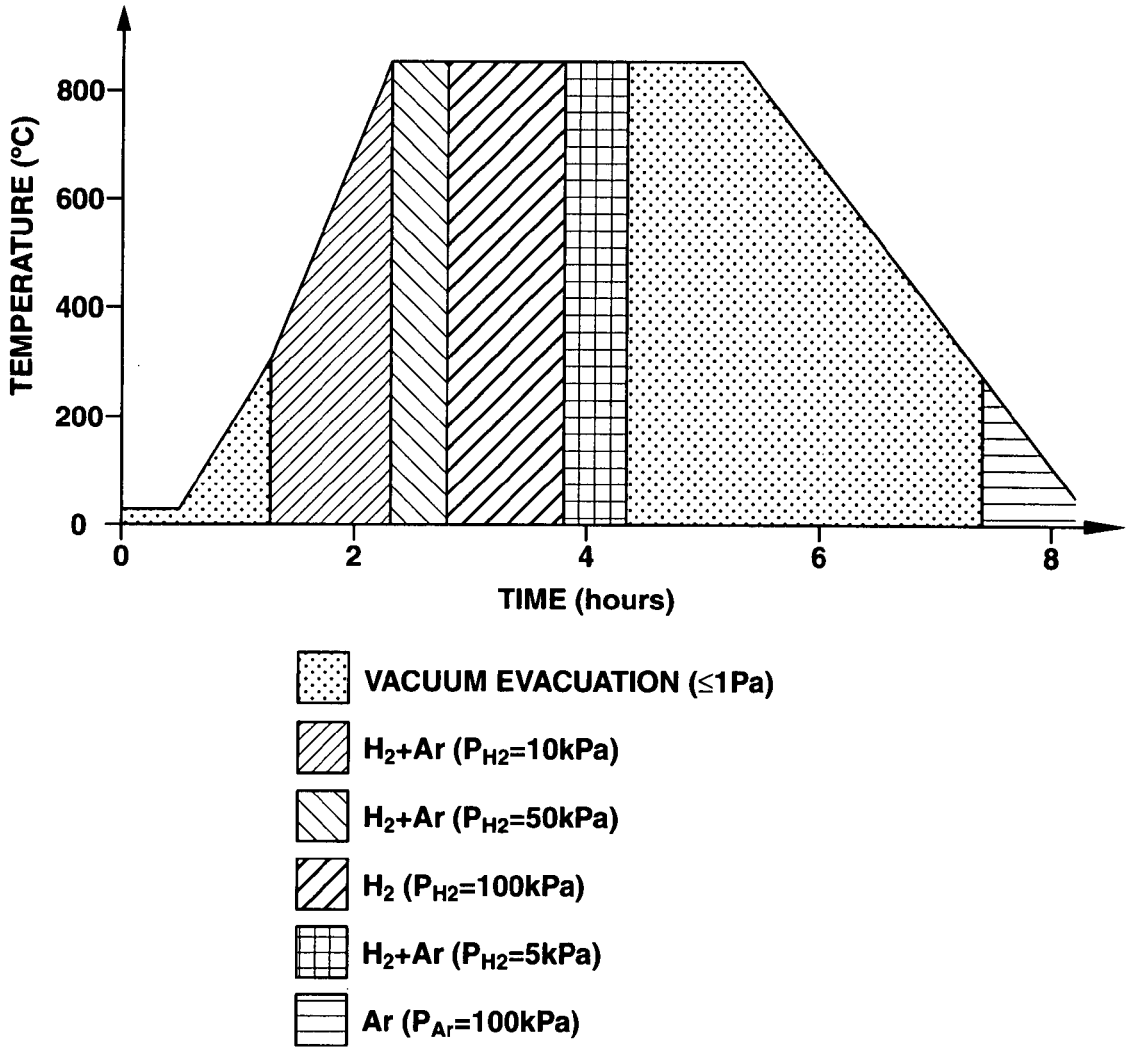
FIG. 1 is a diagram showing the heat treatment schedule in Examples 1 to 3.

The invention is directed to a method for preparing a high-performance rare earth permanent magnet material of compact size or reduced thickness having a specific surface area S/V of at least 6 $mm^{-1}$ from an R—Fe—B sintered magnet body so as to prevent magnetic properties from being degraded by machining of the magnet body surface.

The R—Fe—B sintered magnet body is obtainable from a mother alloy by a standard procedure including crushing, fine pulverization, compaction and sintering.

The mother alloy contains R, iron (Fe), and boron (B). R is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd and Pr being preferably predominant. It is preferred that rare earth elements inclusive of Sc and Y account for 10 to 15 atom %, more preferably 11.5 to 15 atom % of the overall alloy. Desirably R contains at least 10 atom %, especially at least 50 atom % of Nd and/or Pr. It is preferred that boron (B) account for 3 to 15 atom %, more preferably 5 to 8 atom % of the overall alloy. The alloy may further contain one or more elements selected from Al, Cu, Zn, In, Si, P, S, Ti, V, Cr, Mn, Ni, Ga, Ge, Zr, Nb, Mo, Pd, Ag, Cd, Sn, Sb, Hf, Ta, and W, in an amount of 0 to 11 atom %, especially 0.1 to 4 atom %. The balance consists of iron (Fe) and incidental impurities such as C, N, and O. The content of Fe is preferably at least 50 atom %, especially at least 65 atom %. It is acceptable that part of Fe, specifically 0 to 40 atom %, more specifically 0 to 20 atom % of Fe be replaced by cobalt (Co).

The mother alloy is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching technique is applicable as well as the above-described casting technique.

The crushing step uses a Brown mill or hydriding pulverization, with the hydriding pulverization being preferred for those alloys as strip cast. The coarse powder is then finely divided by a jet mill using nitrogen under pressure. The fine powder is compacted on a compression molding machine while being oriented under a magnetic field. The green compact is placed in a sintering furnace where it is sintered in vacuum or in an inert gas atmosphere usually at a temperature of 900 to 1,250° C., preferably 1,000 to 1,100° C.

In this way, a sintered magnet body or sintered block is obtained. It is an anisotropic sintered magnet body having the compositional formula:

$$R_x(Fe_{1-y}Co_y)_{100-x-z-a}B_zM_a$$

wherein R is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$. Notably the magnet body contains a $R_2Fe_{14}B$ compound as a primary phase.

The sintered body or block is then machined into a practical shape. The machining may be carried out by a standard technique. To minimize the influence of residual strain by machining, the machining speed is preferably set as low as possible within the range not detracting from productivity. Specifically, the machining speed is 0.1 to 20 mm/min, more preferably 0.5 to 10 mm/min.

The volume of material removed is such that the resultant sintered block has a specific surface area S/V (surface area $mm^2$/volume $mm^3$) of at least 6 $mm^{-1}$, preferably at least 8 $mm^{-1}$. Although the upper limit is not particularly limited and may be selected as appropriate, it is generally up to 45 $mm^{-1}$, especially up to 40 $mm^{-1}$.

If an aqueous coolant is fed to the machining apparatus or if the machined surface is exposed to elevated temperature during working, there is a likelihood that an oxide film form on the machined surface, which oxide film can prevent absorption and release of hydrogen at the magnet body surface. In this case, the magnet body is washed with at least one of alkalis, acids, and organic solvents or shot blasted for removing the oxide film, rendering the magnet body ready for heat treatment in hydrogen.

After the magnet body is machined into a practical shape, HDDR treatment is carried out according to the schedule described below. Once the anisotropic sintered magnet body is machined so as to acquire a specific surface area of at least 6 $mm^{-1}$, it is heat treated in a hydrogen gas-containing atmosphere at a temperature of 600 to 1,100° C. for inducing disproportionation reaction on the primary phase $R_2Fe_{14}B$ compound, and subsequently heat treated in an atmosphere having a reduced hydrogen gas partial pressure at a temperature of 600 to 1,100° C. for inducing recombination reaction to the $R_2Fe_{14}B$ compound, thereby finely dividing the $R_2Fe_{14}B$ compound phase to a crystal grain size equal to or less than 1 μm.

These treatments are described in more detail. For the disproportionation reaction treatment, generally the magnet body is placed into a furnace, after which heating is started. The atmosphere is preferably a vacuum or an inert gas such as argon while heating from room temperature to 300° C. If the atmosphere contains hydrogen in this temperature range, hydrogen atoms can be absorbed into lattices of $R_2Fe_{14}B$ compound, whereby the magnet body be expanded in volume and hence broken. Over the range from 300° C. to the treatment temperature (600 to 1,100° C., preferably 700 to 1,000° C.), heating is preferably continued in an atmosphere having a hydrogen partial pressure equal to or less than 100 kPa although the hydrogen partial pressure depends on the composition of the magnet body and the heating rate. The heating rate is preferably 1 to 20° C./min. The pressure is limited for the following reason. If heating is effected at a hydrogen partial pressure in excess of 100 kPa, the decomposition reaction of $R_2Fe_{14}B$ compound commences in the heating step (at 600 to 700° C., though dependent on the magnet composition), so that the decomposed structure may grow into a coarse globular shape in the course of heating, which can preclude the structure from becoming anisotropic by recombination into $R_2Fe_{14}B$ compound during the subsequent dehydrogenation treatment. Once the treatment temperature is reached, the hydrogen partial pressure is increased to 100 kPa or above (though dependent on the magnet composition). Under these conditions, the magnet body is held preferably for 10 minutes to 10 hours, more preferably 20 minutes to 8 hours, even more preferably 30 minutes to 5 hours, for inducing disproportionation reaction on the $R_2Fe_{14}B$ compound. Through this disproportionation reaction, the $R_2Fe_{14}B$ compound is decomposed into $RH_2$, Fe, and $Fe_2B$. The holding time is limited for the following reason. If the treating time is less than 10 minutes, disproportionation reaction may not fully proceed, and unreacted $R_2Fe_{14}B$ compound be left in addition to the decomposed products: $RH_2$, α-Fe, and $Fe_2B$. If heat treatment continues over a longer period, magnetic properties can be deteriorated by inevitable oxidation. For these reasons, the holding time is not less than 10 minutes and not more than 10 hours. It is preferred to increase the hydrogen partial pressure stepwise during the isothermal treatment. If the hydrogen partial pressure is increased at a stroke, acute reaction occurs so that the decomposed structure becomes non-uniform. This can lead to non-uniform crystal grain size upon recombination into $R_2Fe_{14}B$ compound during the subsequent dehydrogenation treatment, resulting in a decline of coercivity or squareness.

The hydrogen partial pressure is equal to or more than 100 kPa as described above, preferably 100 to 200 kPa, and more preferably 150 to 200 kPa. The hydrogen partial pressure is increased stepwise to the ultimate value. In an example wherein the hydrogen partial pressure is kept at 20 kPa during the heating step and increased to an ultimate value of 100 kPa, the hydrogen partial pressure is increased stepwise according to such a schedule that the hydrogen partial pressure is set at 50 kPa in a period from the point when the holding temperature is reached to an initial 30% duration of the holding time.

The disproportionation reaction treatment is followed by the recombination reaction treatment. The treating temperature is the same as in the disproportionation reaction treatment. The treating time is preferably 10 minutes to 10 hours, more preferably 20 minutes to 8 hours, even more preferably 30 minutes to 5 hours. The recombination reaction is performed in an atmosphere having a reduced hydrogen partial pressure, preferably a hydrogen partial pressure of 1 kPa to $10^{-5}$ Pa, more preferably 10 Pa to $10^{-4}$ Pa, though the exact hydrogen partial pressure is dependent on the alloy composition.

After the recombination reaction treatment, the magnet body may be cooled at a rate of about −1 to −20° C./min to room temperature.

After the recombination reaction treatment, the sintered magnet body is preferably subjected to aging treatment. The aging treatment is preferably performed at a temperature of 200 to 800° C., more preferably 350 to 750° C. and for a time of 1 minute to 100 hours, more preferably 10 minutes to 20 hours.

Prior to the disproportionation reaction treatment, the sintered magnet body worked to the predetermined shape may be washed with at least one agent selected from alkalis, acids and organic solvents, or shot blasted for removing a surface affected layer therefrom.

Also, after the recombination reaction treatment or after the aging treatment, the sintered magnet body may be washed with at least one agent selected from alkalis, acids and organic solvents, or machined again. Alternatively, plating or paint coating may be carried out after the recombination reaction treatment, after the aging treatment, after the washing step, or after the machining step following the recombination reaction treatment.

Suitable alkalis which can be used herein include potassium pyrophosphate, sodium pyrophosphate, potassium citrate, sodium citrate, potassium acetate, sodium acetate, potassium oxalate, sodium oxalate, etc.; suitable acids include hydrochloric acid, nitric acid, sulfuric acid, acetic acid, citric acid, tartaric acid, etc.; and suitable organic solvents include acetone, methanol, ethanol, isopropyl alcohol, etc. In the washing step, the alkali or acid may be used as an aqueous solution with a suitable concentration not attacking the magnet body.

The above-described washing, shot blasting, machining, plating, and coating steps may be carried out by standard techniques.

According to the invention, compact or thin-type permanent magnets free from degradation of magnetic properties can be provided.

EXAMPLE

Examples and Comparative Examples are given below for further illustrating the invention although the invention is not limited thereto.

The average crystal grain size of a sintered magnet body is determined by cutting a sample from a sintered block, mirror polishing a surface of the sample parallel to the oriented direction, dipping the sample in a nitric acid/hydrochloric acid/glycerin liquid at room temperature for 3 minutes for etching, and taking a photomicrograph of the sample under an optical microscope, followed by image analysis. The image analysis includes measuring the areas of 500 to 2,500 crystal grains, calculating the diameters of equivalent circles, plotting them on a histogram with area fraction on the ordinate, and calculating an average value. The average crystal grain size of a magnet body as HDDR treated according to the invention is determined by observing a fracture surface of the magnet under a scanning electron microscope and analyzing a secondary electron image. A linear intercept technique is used for the image analysis.

Example 1 and Comparative Example 1

An alloy in thin plate form was prepared by using Nd, Fe, Co, and Al metals of at least 99 wt % purity and ferroboron, weighing predetermined amounts of them, high-frequency melting them in an Ar atmosphere, and casting the melt onto a single chill roll of copper (strip casting technique). The alloy consisted of 12.5 atom % Nd, 1.0 atom % Co, 1.0 atom % Al, 5.9 atom % B, and the balance of Fe. It is designated alloy A. The alloy A was machined into a coarse powder of under 30 mesh by the so-called hydride pulverization technique including hydriding the alloy and heating up to 500° C. for partial dehydrating while evacuating the chamber to vacuum.

Separately, an alloy was prepared by using Nd, Dy, Fe, Co, Al, and Cu metals of at least 99 wt % purity and ferroboron, weighing predetermined amounts of them, high-frequency melting them in an Ar atmosphere, and casting the melt in a mold. The alloy consisted of 20 atom % Nd, 10 atom % Dy, 24 atom % Fe, 6 atom % B, 1 atom % Al, 2 atom % Cu, and the balance of Co. It is designated alloy B. The alloy B was crushed to a size of under 30 mesh in a nitrogen atmosphere on a Brown mill.

Subsequently, the powders of alloys A and B were weighed in an amount of 90 wt % and 10 wt % and mixed for 30 minutes on a nitrogen-blanketed V blender. On a jet mill using nitrogen gas under pressure, the powder mixture was finely divided into a powder with a mass base median diameter of 4 μm. The fine powder was oriented in a magnetic field of 15 kOe under a nitrogen atmosphere and compacted under a pressure of about 1 ton/cm$^2$. The green compact was then placed in a sintering furnace with an Ar atmosphere where it was sintered at 1,060° C. for 2 hours, obtaining a sintered block of 10 mm×20 mm×15 mm thick. The sintered block B1 had an average crystal grain size of 5.6 μm.

Using an inner blade cutter, the sintered block was machined on all the surfaces into a rectangular parallelepiped body of the predetermined dimensions having a specific surface area S/V of 22 mm$^{-1}$. The sintered body as machined was successively washed with alkaline solution, deionized water, acid and deionized water, and dried. The magnet body as machined and washed is designated magnet body P1.

The magnet body P1 was subjected to HDDR treatment (disproportionation reaction treatment and recombination reaction treatment) according to the schedule schematically shown in FIG. 1, yielding a magnet body within the scope of the invention. It is designated magnet body M1 and had an average crystal grain size of 0.24 μm.

Magnet bodies M1 and P1 were measured for magnetic properties, which are shown in Table 1. The magnetic properties of magnet block B1 prior to the processing are also shown in Table 1. The coercive force $H_{cB}$ of the magnet block P1, which was machined to a specific surface area S/V of 22 mm$^{-1}$, was about 20% reduced from that of the magnet block B1, whereas the magnet body M1 of the invention showed only a little reduction.

TABLE 1

| | Designation | $B_r$ [T] | $H_{cJ}$ [kAm$^{-1}$] | $H_{cB}$ [kAm$^{-1}$] | $(BH)_{max}$ [kJm$^{-3}$] |
|---|---|---|---|---|---|
| Example 1 | M1 | 1.34 | 880 | 845 | 345 |
| Comparative Example 1 | P1 | 1.34 | 820 | 680 | 305 |
| Prior to processing | B1 | 1.35 | 900 | 860 | 350 |

Example 2 and Comparative Example 2

Using the same composition and procedure as in Example 1, a sintered block of 10 mm×20 mm×15 mm thick was prepared.

Using an inner blade cutter, the sintered block was machined into a rectangular parallelepiped body of the predetermined dimensions having a specific surface area S/V of 36 mm$^{-1}$. The sintered body as machined was successively washed with alkaline solution, deionized water, acid and deionized water, and dried. The sintered body as machined and washed is designated magnet body P2.

The magnet body P2 was subjected to HDDR treatment according to the schedule schematically shown in FIG. 1, yielding a magnet body within the scope of the invention. It is designated magnet body M2 and had an average crystal grain size of 0.26 μm.

Magnet bodies M2 and P2 were measured for magnetic properties, which are shown in Table 2. The coercive force $H_{cB}$ of the magnet block, which was machined to an ultra-compact shape with a specific surface area S/V of 36 mm$^{-1}$, was about 30% reduced from that of the magnet block B1, whereas the magnet body M2 of the invention showed only a little reduction.

TABLE 2

| | Designation | $B_r$ [T] | $H_{cJ}$ [kAm$^{-1}$] | $H_{cB}$ [kAm$^{-1}$] | $(BH)_{max}$ [kJm$^{-3}$] |
|---|---|---|---|---|---|
| Example 2 | M2 | 1.34 | 880 | 840 | 340 |
| Comparative Example 2 | P2 | 1.28 | 790 | 610 | 240 |

Example 3 and Comparative Example 3

An alloy in thin plate form was prepared by using Nd, Co, Al, Fe, and Cu metals of at least 99 wt % purity and ferroboron, weighing predetermined amounts of them, high-frequency melting them in an Ar atmosphere, and casting the melt onto a single chill roll of copper (strip casting technique). The alloy consisted of 14.5 atom % Nd, 1.0 atom % Co, 0.5 atom % Al, 0.2 atom % of Cu, 5.9 atom % B, and the balance of Fe. The alloy was machined into a coarse powder of under 30 mesh by the so-called hydride pulverization technique including hydriding the alloy and heating up to 500° C. for partial dehydrating while evacuating the chamber to vacuum.

On a jet mill using nitrogen gas under pressure, the coarse powder was finely divided into a powder with a mass base median diameter of 4 μm. The fine powder was oriented in a magnetic field of 15 kOe under a nitrogen atmosphere and compacted under a pressure of about 1 ton/cm$^2$. The green compact was then placed in a sintering furnace with an Ar atmosphere where it was sintered at 1,060° C. for 2 hours, obtaining a sintered block of 10 mm×20 mm×15 mm thick. The sintered block B3 had an average crystal grain size of 4.8 μm.

Using an inner blade cutter, the sintered block was machined into a rectangular parallelepiped body of the predetermined dimensions having a specific surface area S/V of 36 mm$^{-1}$. The sintered body as machined was successively washed with alkaline solution, deionized water, acid and deionized water, and dried. The sintered body as machined and washed is designated magnet body P3.

The magnet body P3 was subjected to HDDR treatment according to the schedule schematically shown in FIG. 1, yielding a magnet body within the scope of the invention. It is designated magnet body M3 and had an average crystal grain size of 0.23 μm.

Magnet bodies M3 and P3 were measured for magnetic properties, which are shown in Table 3. The magnetic properties of magnet block B3 prior to the processing are also shown in Table 3. The coercive force $H_{cB}$ of the magnet block P3 as machined to an ultra-compact shape was about 35% reduced from that of the magnet block B3, whereas the magnet body M3 of the invention showed only a little reduction.

TABLE 3

| | Designation | $B_r$ [T] | $H_{cJ}$ [kAm$^{-1}$] | $H_{cB}$ [kAm$^{-1}$] | $(BH)_{max}$ [kJm$^{-3}$] |
|---|---|---|---|---|---|
| Example 3 | M3 | 1.38 | 810 | 770 | 370 |
| Comparative Example 3 | P3 | 1.30 | 680 | 510 | 250 |
| Prior to processing | B3 | 1.39 | 800 | 780 | 375 |

Example 4

Using the same composition and procedure as in Example 1, a sintered block of 10 mm×20 mm×15 mm thick was prepared.

Using an outer blade cutter, the sintered block was machined into a rectangular parallelepiped body of the predetermined dimensions having a specific surface area S/V of 22 mm$^{-1}$. The sintered body as machined was successively washed with alkaline solution, deionized water, acid and deionized water, and dried.

The sintered body was subjected to HDDR treatment according to the schedule schematically shown in FIG. 1. The magnet body was successively washed with alkaline solution, deionized water, acid and deionized water, and dried. The resulting magnet body within the scope of the invention, designated magnet body M4, had an average crystal grain size of 0.24 μm.

Magnet body M4 was measured for magnetic properties, which are shown in Table 4. Satisfactory magnetic properties were maintained when the HDDR treatment was followed by the washing step.

TABLE 4

| | Designation | $B_r$ [T] | $H_{cJ}$ [kAm$^{-1}$] | $H_{cB}$ [kAm$^{-1}$] | $(BH)_{max}$ [kJm$^{-3}$] |
|---|---|---|---|---|---|
| Example 4 | M4 | 1.34 | 880 | 845 | 345 |

Examples 5 and 6

Using the same composition and procedure as in Example 1, a sintered block of 10 mm×20 mm×15 mm thick was prepared.

Using an outer blade cutter, the sintered block was machined into a rectangular parallelepiped body of the predetermined dimensions having a specific surface area S/V of 6 mm$^{-1}$. The sintered body as machined was successively washed with alkaline solution, deionized water, acid and deionized water, and dried.

The sintered body was subjected to HDDR treatment according to the schedule schematically shown in FIG. 1. Using an inner blade cutter, the magnet body was machined into a rectangular parallelepiped body of the predetermined dimensions having a specific surface area S/V of 36 mm$^{-1}$. The resulting magnet body within the scope of the invention, designated magnet body M5, had an average crystal grain size of 0.21 μm.

The magnet body was subjected to electroless copper/nickel plating, obtaining a magnet body M6 within the scope of the invention.

Magnet bodies M5 and M6 were measured for magnetic properties, which are shown in Table 5. The magnet resulting from the HDDR treatment and the subsequent plating step exhibits equivalent magnetic properties to the magnet M2 which was machined to an ultra-compact shape having a specific surface area S/V of 36 mm$^{-1}$ in advance of the HDDR treatment.

TABLE 5

| | Designation | $B_r$ [T] | $H_{cJ}$ [kAm$^{-1}$] | $H_{cB}$ [kAm$^{-1}$] | $(BH)_{max}$ [kJm$^{-3}$] |
|---|---|---|---|---|---|
| Example 5 | M5 | 1.34 | 880 | 840 | 340 |
| Example 6 | M6 | 1.34 | 880 | 840 | 340 |

Japanese Patent Application No. 2006-112306 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a permanent magnet material, comprising the steps of:

providing an anisotropic sintered magnet body having the compositional formula: $R_x(Fe_{1-y}Co_y)_{100-x-z-a}B_zM_a$ wherein R is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R_2Fe_{14}B$ compound as a primary phase, machining the magnet body to a specific surface area of at least 6 mm$^{-1}$, heat treating the magnet body which has been machined in a hydrogen gas-containing atmosphere at 600 to 1,100° C., for inducing disproportionation reaction on the $R_2Fe_{14}B$ compound, continuing the heat treatment in an atmosphere having a reduced hydrogen gas partial pressure at 600 to 1,100° C., for inducing recombination reaction to the $R_2Fe_{14}B$ compound, thereby finely dividing the $R_2Fe_{14}B$ compound phase to a crystal grain size equal to or less than 1 μm, and washing the magnet body with at least one agent of alkalis, acids and organic solvents, after the recombination reaction treatment.

2. The method of claim 1, further comprising washing the machined magnet body with at least one agent of alkalis, acids and organic solvents, prior to the disproportionation reaction treatment.

3. The method of claim 1, further comprising shot blasting the machined magnet body for removing a surface affected layer therefrom, prior to the disproportionation reaction treatment.

4. A method for preparing a permanent magnet material, comprising the steps of:

providing an anisotropic sintered magnet body having the compositional formula: $R_x(Fe_{1-y}Co_y)_{100-x-z-a}B_zM_a$ wherein R is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R_2Fe_{14}B$ compound as a primary phase, machining the magnet body to a specific surface area of at least 6 $mm^{-1}$, heat treating the magnet body which has been machined in a hydrogen gas-containing atomosphere at 600 to 1,100° C., for inducing disproportionation reaction on the $R_2Fe_{14}B$ compound, contnuing the heat treatment in an atmosphere having a reduced hydrogen gas partial pressure at 600 to 1,100° C., for inducing recombination reaction to the $R_2Fe_{14}B$ compound, thereby finely dividing the $R_2Fe_{14}B$ compound phase to a crystal grain size equal to or less that 1 μm, and machining the magnet body, after the recombination reaction treatment.

5. The method of claim 1, further comprising plating or coating the magnet body, after the recombination reaction treatment, or after an alkali, acid or organic solvent washing step following the recombination reaction treatment, or after a machining step following the recombination reaction treatment.

6. The method of claim 4, further comprising washing the machined magnet body with at least one agent of alkalis, acids and organic solvents, prior to the disproportionation reaction treatment.

7. The method of claim 4, further comprising shot blasting the machined magnet body for removing a surface affected layer therefrom, prior to the disproportionation reaction treatment.

8. The method of claim 4, further comprising plating or coating the magnet body, after the recombination reaction treatment, or after an alkali, acid or organic solvent washing step following the recombination reaction treatment, or after a machining step following the recombination reaction treatment.

* * * * *